US005423419A

United States Patent [19]

Wentz et al.

[11] Patent Number: 5,423,419

[45] Date of Patent: Jun. 13, 1995

[54] WATERPROOF, FLOATABLE EYEGLASS CASE

[76] Inventors: Richard J. Wentz; Garwing Wu, both of c/o Witz Products & Designs, 502 Giuseppe Ct., Ste. 5, Roseville, Calif. 95678

[21] Appl. No.: 238,715

[22] Filed: May 5, 1994

Related U.S. Application Data

[63] Continuation-in-part of Ser. No. 018,439, Feb. 7, 1994.

[51] Int. Cl.[6] ..... B65D 85/38

[52] U.S. Cl. ..... 206/6; 220/324; 220/344; D3/215

[58] Field of Search ..... 206/5, 6; 220/324, 334, 220/337, 338, 342, 343, 344, 669, 675; D3/215

[56] References Cited

U.S. PATENT DOCUMENTS

| | | | |
|---|---|---|---|
| 1,748,430 | 2/1930 | Stringham | 206/5 |
| 2,371,557 | 3/1945 | Sullivan | 206/6 |
| 2,850,220 | 9/1958 | Ehrler et al. | 224/245 |
| 3,845,799 | 11/1974 | Mittell | 206/5 |
| 4,295,345 | 10/1981 | Atkinson | D3/215 |
| 4,744,461 | 5/1988 | Lapham | 206/5 |
| 4,782,941 | 11/1988 | Freise | 206/5 |
| 4,905,857 | 3/1990 | Her | 206/811 |
| 5,261,582 | 11/1993 | Mathews et al. | 206/5 |

*Primary Examiner*—Jimmy G. Foster

*Attorney, Agent, or Firm*—Julian Caplan; Flehr, Hohbach, Test, Albritton & Herbert

[57] ABSTRACT

A case is molded of light-weight, thin-walled plastic in two hollow parts which when assembled, receives eyeglasses and sunglasses of many different designs and sizes. The case is slightly concave on one broad side surface and convex on the other. The upper edge of the lower part slants downwardly from one end, as does the upper edge of the upper port or lid. The two parts are hinged together at the higher end walls. A toggle-type latch is provided at the lower end walls. A gasket in the meeting edges is compressed when the clasp is engaged to close the case in a water-tight manner. There is sufficient volume within the case so that it will float. A projection on the top is apertured for a chain, thong, string or the like so that the case may be worn hanging from the neck. The concave-convex shapes of the sides accommodates eyeglasses without making the case unnecessarily thin. Such shape likewise makes wearing the case in a hip or shirt pocket comfortable.

3 Claims, 1 Drawing Sheet

WATERPROOF, FLOATABLE EYEGLASS CASE

CROSS REFERENCE TO RELATED APPLICATIONS

This application is a continuation-in-part of copending U.S. design application, Ser. No. 29/018,439, filed Feb. 7, 1994. This application is also an improvement upon U.S. Pat. No. 5,125,531.

BACKGROUND OF THE INVENTION

1. Field of the Invention

This invention relates to a new and improved waterproof, floatable eyeglass case. More particularly, the invention relates to a light-weight, thin-walled plastic case composed of two parts. When assembled the parts have thin convex end walls and a pair of side walls, one of which is slightly concave and the other is convex. The overall shape is such as to readily accommodate eyeglasses of various shapes and sizes. The lower part of the case, which is considerably larger than the upper part, has an upper edge which slants downwardly-forwardly as does the lower edge of the upper part. The two parts are hinged together at the higher end wall of the lower part and are drawn tightly together by a latch at the opposed end wall. A suitable gasket in the parting surfaces of the upper and lower parts is compressed when the latch is engaged to make the case water-tight. By reason of the concave, convex shape of the case, it may be comfortably worn in a hip, jacket or shirt pocket, accommodating the shape of the wearer. Further, an apertured projection on the top of the case may receive a chain, thong or the like so that the device may be worn around the neck or waist or attached to a key chain. preferrably the interior of the case is lined to protect the eyeglasses. Large sponge-rubber pads may be inserted at either end to prevent the eyeglasses from being jarred from end-to-end.

2. Description of Related Art

U.S. Pat. No. 5,125,531 is a carrying case for such items as hotel room keys, credit cards and other small items. In this type case the side walls are substantially identical and only slightly convex, whereas the device of the present application is slightly concave on one side and considerably convex on the opposite side in order to accommodate the thickness of eyeglasses. Furthermore, the proportions of the two cases by way of height, width and thickness are considerably different.

U.S. Pat. No. 4,905,557 is shaped to fit the hip of the wearer when a belt or band secures the case to the waist. Other advantages of the present invention over this reference are readily apparent.

SUMMARY OF THE INVENTION

The case is specially shaped to accommodate eyeglasses and sun glasses of various sizes and designs. It consists of a lower part and an upper part which are hinged together and brought into tight engagement by a latch to form a water-tight enclosure. By reason of the weight of the case and its contents as compared with its volume, the case floats when dropped in the water.

The lower part of the case has an inclined upper margin carrying a gasket in a groove formed therein. When the upper part is hinged downward it engages the gasket. When positioned in the lower part of the case, a portion of the eyeglasses project above the inclined upper edge so that the eyeglasses may be easily gripped and removed from the case.

Another feature of the invention is that the two parts of the case may be molded of a light weight, thin-walled plastic so that the weight of the case and its contents as compared with its volume causes the case to float if dropped in water.

A transverse projection in the top is formed with a hole so that the case may be suspended from the neck or waist by means of a cord, chain or belt. Other items such as a key ring may be attached in this manner.

Padding on the interior protects the glasses. Preferrably sponge-rubber cushions are installed at either end to prevent glasses of various sizes from shifting from end to end as the wearer's position changes

BRIEF DESCRIPTION OF THE DRAWINGS

The accompanying drawings, which are incorporated in and form a part of this specification, illustrate embodiments of the invention and, together with the description, serve to explain the principles of the invention.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

The eyeglass case which is the subject of this invention has a lower part 12 which is hollow and has an open upper end 22. Typically the angle of the upper edge 22 relative to the horizontal is between 15° and 30°. Cover 14 is hingably mounted for movement between an open position and a closed position.

Figure 4:
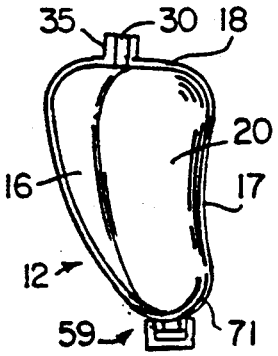
FIG. 4 is a bottom plan view.
Figure 5:
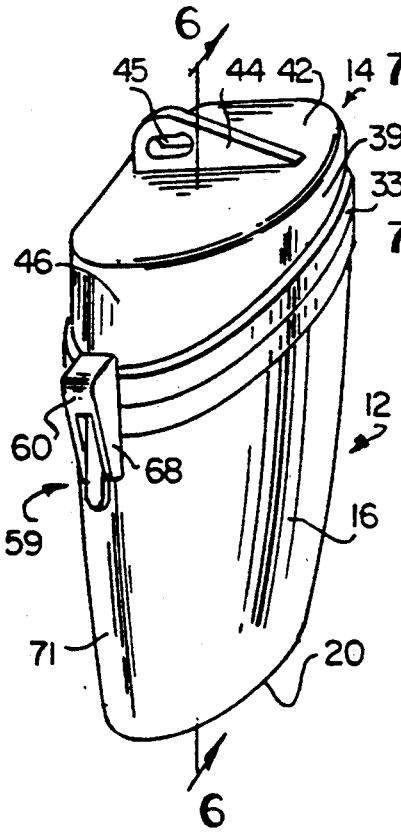
FIG. 5 is a perspective view of the case in closed condition.

Lower part 12 has opposed side walls 16 and 17. As best seen in FIG. 4, side wall 16 is convex both in relation to a plane perpendicular to the central axis of the case and also in a plane through the central axis and perpendicular to surface 16. 0n the other hand, the opposed side wall 17 is slightly concave in the plane transverse to the central axis and is relatively straight in a plane parallel to the central axis. The opposed end walls 18 and 71 are relatively convex and the wall 71 is of less width in a horizontal plane than is the opposed end wall 18. The configuration of the side walls reinforces the case and increases their strength against collapse under stress.

The users' eyeglasses thus fit conveniently within the lower case 12 but project up above the slanted top edge 22 thereof. Bottom wall 20 is preferably flat so that the case may stand on a level surface.

Figure 6:
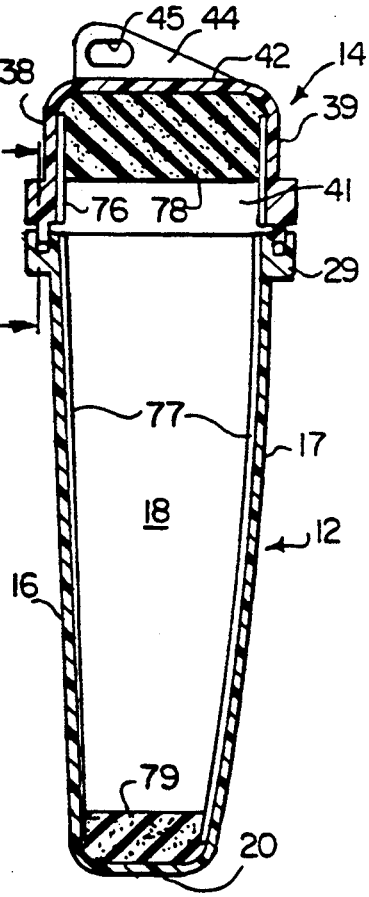
FIG. 6 is a sectional view taken along line 6—6 of FIG. 5

A continuous groove 24 extends around upper edge 22 and receives a resilient gasket 26 (see especially FIG. 6). The gasket 26 functions as a water-tight seal when the cover 14 is engaged. Preferably a thickened rim 29 is formed around the perimeter of the lower part of the case at the upper edge 22 to reinforce the lower portion and also to provide additional thickness for the groove 24. Hence, the side walls of the case may be thin and are reinforced by the rim 29. On the higher end wall 18 adjacent the top an ear is located for the purpose of hinging lower part 12 to the upper part 14 as hereinafter explained.

Upper portion or cover 14 has a pair of opposed side walls 40 and 41 and a top wall 42 as well as side walls 38 and 39. The curvatures of walls 38, 39, 40 and 41 generally matches those of the walls 17, 16, 71 and 18, respectively, when the cover is closed. Extending transversely across top wall 42 is a triangular projection 44 formed with an aperture 45 (here shown oval in shape) to receive a string, thong, cord or other device from which the case may be suspended. Upper case 14 has a slanted lower edge 43 which matches edge 22. A circumferential downward projecting rib 50 is formed on edge 43. Preferably the edge 43 is reinforced by an enlarged rim 33 similar to rim 29.

Directing attention now to FIG. 6 it will be seen that when the cover is closed the rib 51 deforms the resilient gasket 26 in the groove 24 to form a tight seal. A pair of ears 35 extend from end wall 41 and receive ear 30 therebetween. A pin 34 provides a hinge so that the cover may open and close.

Figure 3:
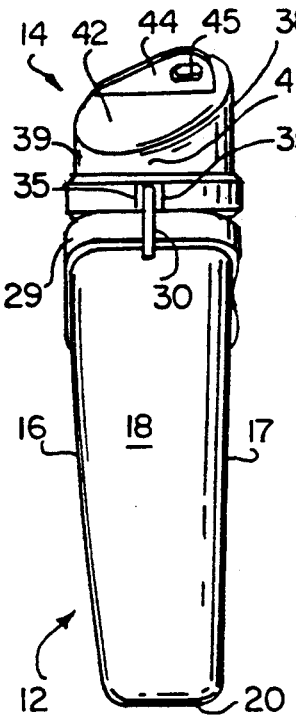
FIG. 3 is a side-elevational view from the left of FIG. 1.
Figure 1:
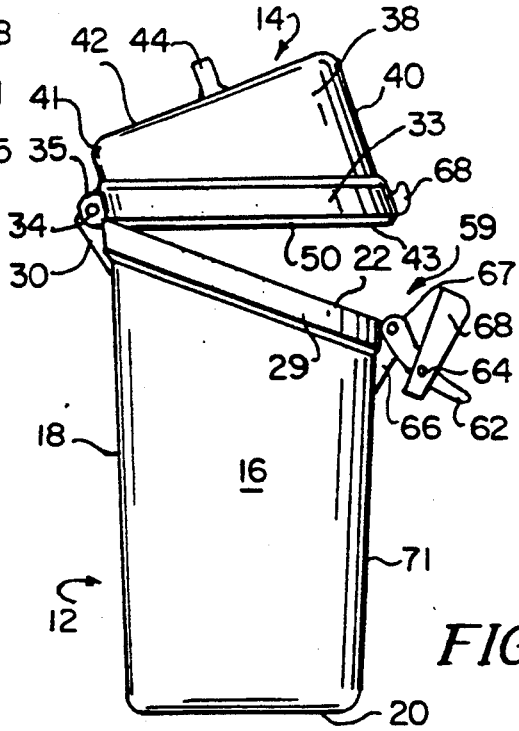
FIG. 1 is a side-elevational view of the eyeglass case partially open.
Figure 2:
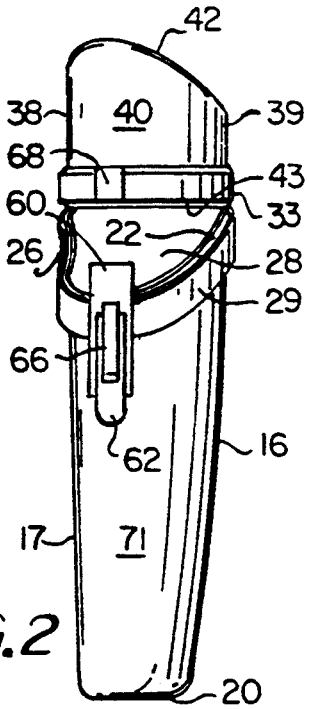
FIG. 2 is a side-elevational view from the right of FIG. 1.
Figure 7:
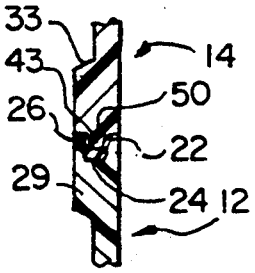
FIG. 7 is an enlarged fragmentary sectional view taken substantially along line 7—7 of FIG. 6 through the meeting edges of the upper and lower parts of the case showing the seal.

A preferred latch 59 comprises an ear 66 projecting outwardly from end wall 71 adjacent the top thereof to which is pivoted by means of pin 67 a lever 62. Approximately midway of the length of lever 62 is an inverted U-shaped member 60 pivoted thereto by means of pin 64. A hook-shaped latch member 68 is formed projecting outwardly adjacent the lower edge of end wall 40 of cover 14. When cover 14 is closed, U-shaped member 60 may be brought over hook 68. By depressing lever 62, the hook 68 (and with it the cover 14) are brought tight against the lower case portion 12. Inasmuch as the pin 64 is located closer to wall 71 than pin 67, the latch functions as a toggle member to hold the cover tightly shut, compressing the gasket 26. In order to open the case, the user merely pivots the lever 62 upwardly and swings the U-shape member 60 away from the hook 68 (see the position of FIG. 1).

As shown particularly in FIG. 6, the interiors of both upper part 14 and lower part 12 are lined with a felt-coated fabric liner 76 and 77 respectively. The linings are attached by adhesive (not illustrated). Scratching of the lines and other damage to the lenses and frames is reduced by reason of the lining.

As also shown in FIG. 6, sponge-rubber pads 78 and 79 are inserted in the top of upper part 14 and the bottom of lower part 12. The pads are quite compressible and hence the ends of the eyeglasses are embedded in the pads. Adhesive (not shown) also retains each of said pads 78 and 79 in its respective part of said case. The resilient pads protect the glasses from damage which might occur if the glasses are jarred from end to end by activity of the wearer or if the case were dropped. Further, since the pads are compressable, they can accomodate long frame glasses and yet hold short frame glasses against movement.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An eyeglass case formed of light-weight, thin walled plastic material comprising:

a hollow lower part having a bottom wall, first and second opposed lower end walls extending upward from said bottom wall, a first lower side wall and an opposed second lower side wall extending upward from said bottom wall and each said lower side wall being joined to said lower end walls, said first lower end wall being longer than said second lower end wall, said first lower side wall being convex, said second lower side wall being concave, said lower part having a lower top face slanting downward from said first lower end wall to said second lower end wall, a hollow upper part having a top wall, first and second opposed upper end walls extending downward from said top wall, a first upper side wall and an opposed second upper side wall extending downward from said top wall and each said upper side wall being joined to said upper end walls, said first upper side wall being convex and comprising an extension of said first lower side wall, said second upper side wall being concave and comprising an extension of said second lower side wall, said first upper end wall being shorter than said second upper end wall, said upper part having an upper bottom face slanting downward from said first upper end wall to said second upper end wall to engage said lower top face when said case is closed, said lower first side wall curving upwardly-outwardly from said lower bottom wall, the perimeter of said lower top face being substantially larger than the perimeter of said bottom wall, and said upper first wall curving downwardly-outwardly from said top wall, the perimeter of said upper bottom face being substantially larger than the perimeter of said top wall, a first distance between said lower first and second side walls being substantially greater adjacent said lower first end wall than a second distance between said lower first and second side walls adjacent said lower second end wall to accommodate a folded pair of eyeglasses fitting closely within said hollow lower part, said first distance being substantially greater adjacent said lower top face than adjacent said lower bottom wall, said lower top face and said upper bottom face being substantially co-extensive, hinge means on said upper and lower first end walls pivotally mounting said upper and lower pans together so said case can be opened and closed, and latch means for latching said upper and lower parts together in closed position.

2. An eyeglass case according to claim 1 which further comprises seal means on said lower top face and said upper bottom face to seal said upper and lower parts together in water-tight fashion when said case is closed, said seal means comprising a groove in said lower top face, a gasket in said groove and a rib on said upper bottom face engaging said gasket when said case is closed.

3. An eyeglass case according to claim 1 which further comprises a thick, resilient compressible pad in each end of said parts to cushion an eyeglass in said case against impact.

* * * * *